US006305741B1

(12) United States Patent
Fernandez

(10) Patent No.: US 6,305,741 B1
(45) Date of Patent: Oct. 23, 2001

(54) FOLDABLE CHAIR WITH HANDLE

(76) Inventor: Martin Fernandez, 1656 W. 65 St., Hialeah, FL (US) 33012

( * ) Notice: Subject to any disclaimer, the term of this patent is extended or adjusted under 35 U.S.C. 154(b) by 0 days.

(21) Appl. No.: 09/824,592

(22) Filed: Apr. 2, 2001

(51) Int. Cl.[7] ..... A47C 1/126
(52) U.S. Cl. ..... 297/14; 108/48
(58) Field of Search ..... 297/14, 331, 335, 297/332, 333; 108/38, 48

(56) References Cited

U.S. PATENT DOCUMENTS 5,185,892 * 2/1993 Mitchell ..... 297/14 X
5,282,679 * 2/1994 Redelinghuys ..... 108/48 X
5,950,256 * 9/1999 Slater ..... 297/14 X
5,967,255 * 10/1999 Young ..... 297/14 X
5,984,397 * 11/1999 Dawsan et al. ..... 297/14 X

* cited by examiner

*Primary Examiner*—Peter R. Brown
(74) *Attorney, Agent, or Firm*—J. Sanchelima

(57) ABSTRACT

A foldable chair that includes a back assembly that is rigidly mounted to a vertical wall and a hingedly mounted seat assembly movable between two extreme positions. One of these positions being parallel to the back assembly and the other one perpendicularly thereto. A latch assembly is provided to releasably keep the seat assembly firmly attached to the back assembly in one of the extreme positions. A supporting assembly is pivotally mounted to the underside of the seat assembly. The supporting assembly includes a pivotally mounted frame member and a leg member mounted at a predetermined angle that is slightly greater than ninety degrees to prevent the leg member from slipping back towards the seat assembly when load is applied to the latter. When the seat assembly is brought to the vertical extreme position adjacent to the back assembly, the frame member protrudes to provide a cooperative grip for a user.

5 Claims, 2 Drawing Sheets

FOLDABLE CHAIR WITH HANDLE

BACKGROUND OF THE INVENTION

1. Field of the Invention

The present invention relates to a foldable chair and more particularly, to a foldable chair that includes a handle.

2. Description of the Related Art

Many designs for foldable chairs have been designed in the past. These designs are used where space is at a premium, such as a bathtub, boat, etc. None of the designs available today, however, includes a foldable chair where the support members are hingedly mounted to the seat member's underside that doubles as a handle. The typical goat folds or is removable from a fixed engagement in or around a tub, for instance. Frequently, it is a large unattractive object. The present solution helps a user get out of the tub when folded providing a firm and reliable handle.

Other designs incorporating the closest subject matter provide for a number of more or less complicated features that fail to solve the problem in an efficient and economical way. None of these designs suggest the novel features of the present invention.

SUMMARY OF THE INVENTION

It is one of the main objects of the present invention to provide a foldable chair assembly that doubles as a handle member, when folded away.

It is another object of this invention to provide a foldable chair assembly that is volumetrically efficient.

It is still another object of the present invention to provide a foldable chair assembly that blends with the surroundings with minimum use of available space.

It is yet another object of this invention to provide such an assembly that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
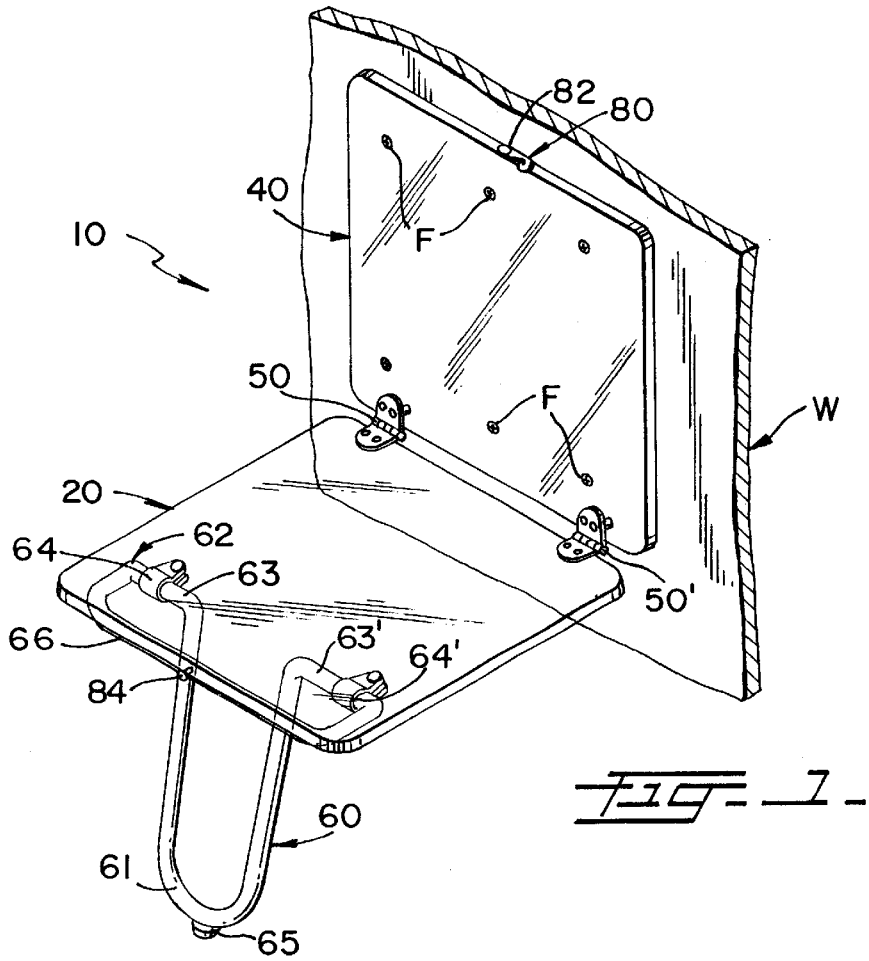
FIG. 1 represents an isometric view of the chair in the open position to be used as a chair.

Referring now to the drawings, where the present invention is generally referred to with numeral 10, it can be observed that it basically includes seat assembly 20 hingedly mounted to back assembly 40. Supporting member 60 is hingedly mounted to the underside of seat assembly 20. Back assembly 40 is firmly mounted to a vertical surface or wall W through fastening members F, as shown in FIG. 1.

Figure 4:
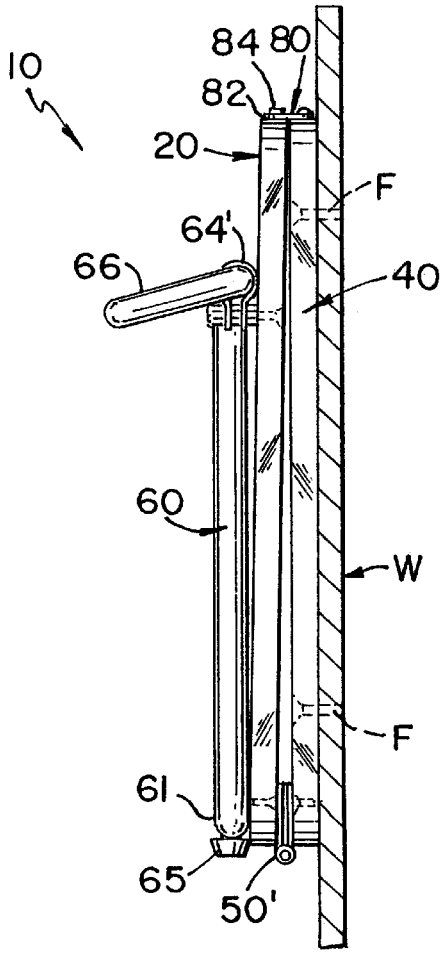
FIG. 4 is a representation of side elevational view of the invention in the closed position.

Supporting assembly 60 has two ends. One end has U-shape leg member 61 suitable for supporting seat assembly 20 and its load. Anti-skid member 65 can be optionally used and it can be made out of rubber or similar material. The other end includes transversal elongated frame member 62 journaled by receiving sleeves 64 and 64' at portions 63 and 63'. Handle member 66 extends at a parallel and spaced apart relationship with respect to portions 63 and 63'. As it can be best seen in FIG. 4, the plane of frame member 62 is not exactly perpendicular to the plane of leg member 61. This permits a more stable structure when leg member 61 is extended preventing it from slipping back to the folded position. A few degrees away from being perpendicular its all that is required. The load on assembly 20 is thus transmitted through its underside to frame member 62 and thus to leg member 61 and the tub floor. Handle member 66 comes in contact with underside of seat assembly 20 thereby limiting the travel of leg member 61.

Figure 2:
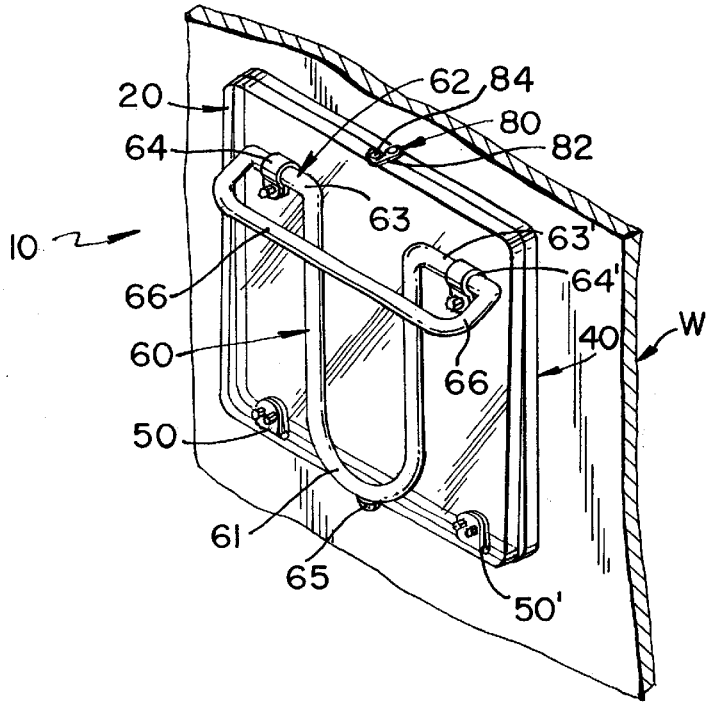
FIG. 2 shows an isometric view of the chair in the closed position to be used as a handle.
Figure 3:
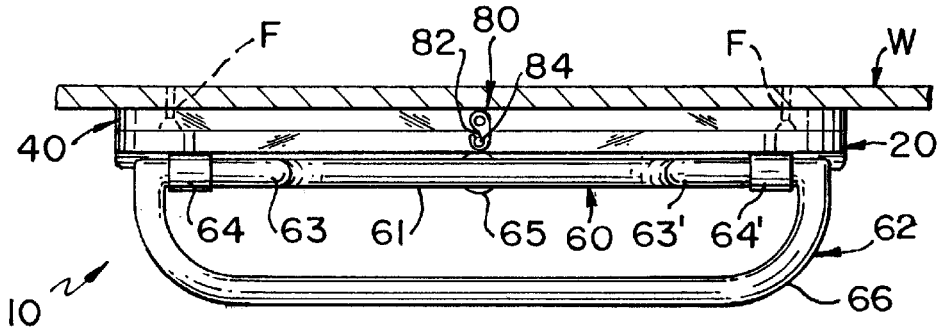
FIG. 3 illustrates top view of the invention in the closed position.

In FIG. 2, seat assembly 20 is shown in the folded up position being firmly kept in that position by latch assembly 80. Assembly 80 includes, in the preferred embodiment, hook member 82 and cooperative headed pin 84. Other equivalent assemblies can be used and this one is just representative of other possible implementations.

In one of the preferred embodiments, seat and back assemblies 20 and 40 respectively, are made out of a plastic transparent material thereby minimizing the detracting aesthetic features associated with these assemblies. In this manner, foldable chair 10 blends almost unconspicously with the surroundings.

Seat assembly 20 is mounted to back assembly 40 by hinge members 50 and 50'. In this manner, seat assembly 20 is movable between a horizontal position when the invention is being used as a seat and a vertical position when seat assembly 20 is kept against back assembly 40.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A foldable chair, comprising:

A) a substantially flat back assembly rigidly mounted to a vertical surface;

B) a seat assembly hingedly mounted to said back assembly and said seat assembly including an underside, said seat assembly being movable between a first and a second extreme positions;

C) latch means for selectively keeping said seat assembly in said first extreme position at a parallel and abutting relationship with respect to said back assembly; and D) pivotally mounted supporting means movable between third and fourth extreme positions, said supporting means including a frame member defining a plane and an elongated leg member rigidly mounted to said frame member at a predetermined angle that is substantially perpendicular with respect to said plane so that said leg member is brought in abutting contact with said underside in said third extreme position with said frame member extending outwardly thereby providing a suitable grip for a user and said leg member being selectively brought to said fourth extreme position, in substantial perpendicular relationship with said seat assembly, keeping the latter in a substantially horizontal position and said frame member coacts with said underside thereby defining said fourth extreme position.

2. The foldable chair set forth in claim 1 wherein said predetermined angle is slightly over and ninety degrees thereby ensuring that said leg member does not slip back towards said seat assembly when the latter is in the horizontal position and a load is applied.

3. The foldable chair set forth in claim 2 wherein said frame member includes a handle member that extends transversally at a spaced apart relationship with respect to said underside when said third extreme position.

4. The foldable chair set forth in claim 3 wherein said back and seat assemblies are made out of a transparent material.

5. The foldable chair set forth in claim 4 wherein said frame member further includes portions that extend at a parallel and spaced apart relationship with respect to said handle member and sleeves rigidly mounted to said underside pivotally journalling said portions.

* * * * *